US012349810B2

(12) United States Patent
Perdigao

(10) Patent No.: US 12,349,810 B2
(45) Date of Patent: Jul. 8, 2025

(54) PORTABLE SLEEPING DEVICE

(71) Applicant: Patricia Perdigao, Oxnard, CA (US)

(72) Inventor: Patricia Perdigao, Oxnard, CA (US)

( * ) Notice: Subject to any disclaimer, the term of this patent is extended or adjusted under 35 U.S.C. 154(b) by 294 days.

(21) Appl. No.: 17/944,480

(22) Filed: Sep. 14, 2022

(65) Prior Publication Data

US 2024/0081539 A1 Mar. 14, 2024

(51) Int. Cl.
*A47C 7/38* (2006.01)
*A47C 16/00* (2006.01)

(52) U.S. Cl.
CPC ..... *A47C 7/383* (2013.01); *A47C 16/00* (2013.01)

(58) Field of Classification Search
CPC ..... A47C 7/383; A47C 7/386; A47C 16/00; A47G 9/0253; A47G 9/1009; A47G 9/1054; A47G 9/1027
See application file for complete search history.

(56) References Cited

U.S. PATENT DOCUMENTS 7,552,733 B1 * 6/2009 Schubert, III ..... A47C 16/00 5/607
2011/0277238 A1 * 11/2011 Mabry ..... A47C 16/00 5/112
2013/0232696 A1 * 9/2013 Halimi ..... A47C 16/00 5/640
2013/0276236 A1 * 10/2013 Rasmussen ..... A47G 9/1027 5/636
2014/0033439 A1 * 2/2014 Berhanu ..... A47C 16/00 5/640
2017/0340127 A1 * 11/2017 Bennetts ..... A61G 13/12
2018/0084919 A1 * 3/2018 Rayburn ..... A47C 7/383
2018/0289182 A1 * 10/2018 McEntee ..... A47G 9/1081

* cited by examiner

*Primary Examiner* — Justin C Mikowski
*Assistant Examiner* — Alison N Labarge
(74) *Attorney, Agent, or Firm* — Sandy Lipkin

(57) ABSTRACT

The present invention relates to a portable sleeping device primarily comprised of a body that is further comprised of at least one vertical frame member, at least one bottom member with at least one inflatable cushion, at least one top member, at least one cushion and at least one carrying case. The vertical frame member holds the device upright while at least one hinge attaches both the top member and bottom member to the vertical frame at a 90-degree angle. A cushion within a cover is removably attached to the top member to enhance the device's comfort. Both the cushion and the top member are generally u-shaped. The bottom member features an inflatable cushion also within a cover to further increase comfort. To use the device, a user can lean forward and rest his or her head on the cushion.

17 Claims, 4 Drawing Sheets

PORTABLE SLEEPING DEVICE

FIELD OF THE INVENTION

The present invention relates generally to the field of sleeping devices. More specifically, the present invention relates to a portable sleeping device. The device is primarily comprised of a body that is further comprised of at least one vertical frame member, at least one bottom member with at least one inflatable cushion, at least one top member, at least one cushion and at least one carrying case. The vertical frame member holds the device upright while at least one hinge attaches both the top member and bottom member to the vertical frame at a 90-degree angle. A cushion is removably attached to the top member to enhance the device's comfort. Both the cushion and the top member are generally u-shaped. The bottom member features an inflatable cushion to further increase comfort. To use the device, a user can lean forward and rest his or her head on the cushion. Accordingly, the present disclosure makes specific reference thereto. Nonetheless, it is to be appreciated that aspects of the present invention are also equally applicable to other like applications, devices and methods of manufacture.

BACKGROUND

A vast majority of people will find themselves traveling long distances at some point in their lives. For many, this may occur late at night or over a period of multiple hours. During these trips, travelers will want to rest either to pass the time or to get much-needed sleep. However, sleeping in cars, planes, trains, etc., is a tremendously uncomfortable experience. To a certain extent, this discomfort and inability to sleep can cause significant health problems, especially for those who travel often. Many individuals may try to rest their head on a window or position their elbow on an armrest and lay their head in their hand. However, these strategies are uncomfortable and only afforded to those privileged enough to sit by a window or have adequate elbow room. One common strategy is to cross your arms on a surface in front of you, lean forward, and lay your head down on your arms. However, this technique can cause tremendous strain and discomfort on a person's back and neck. Moreover, a person's arms are not optimal for comfortable sleep. Travel often leaves travelers sleep-deprived, sore and cranky for these reasons.

Therefore, there exists a long-felt need in the art for a portable sleeping device that reduces the discomfort of sleeping while traveling. There also exists a long-felt need in the art for a portable sleeping device that provides a user with maximum comfort to boost the quality of the user's sleep. Moreover, there exists a long-felt need in the art for a portable sleeping device that can be collapsed to fit into a carrying bag such that it is easily transportable.

The subject matter disclosed and claimed herein, in one embodiment thereof, comprises a portable sleeping device. The device is primarily comprised of a body that is further comprised of at least one vertical frame member, at least one bottom member with at least one inflatable cushion, at least one top member, at least one cushion and at least one carrying case. The vertical frame member holds the device upright while at least one hinge attaches both the top member and bottom member to the vertical frame at a 90-degree angle. A cushion is removably attached to the top member to enhance the device's comfort. Both the cushion and the top member are generally u-shaped. The bottom member features an inflatable cushion to further increase comfort. To use the device, a user can lean forward and rest his or her head on the cushion.

In this manner, the portable sleeping device of the present invention accomplishes all of the foregoing objectives and provides a device that allows a user to mitigate the discomfort, soreness and pain that results from sleeping while traveling. Further, because the device is comprised of additional cushions, a user's sleep is actually enhanced when he or she utilizes the device due to the ergonomic position the device places the user into. Lastly, because the device is collapsible and is comprised of lightweight materials, it allows a user to transport the device in a carrying case with ease.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a portable sleeping device. The device is primarily comprised of a body that is further comprised of at least one vertical frame member, at least one bottom member with at least one inflatable cushion, at least one top member, at least one cushion, and at least one carrying case. The vertical frame, bottom, and top members are preferably attached to one another via at least one spring hinge. The device can be collapsed and folded inward through the hinges, such that a user can transport the device in a carrying case. The hinges may be locked when the device is deployed at a position greater than 45 degrees. In this manner, the top and bottom members of the body connect perpendicular to the vertical frame. This results in a structure that is lifted high enough for a user to rest his or her head on it without straining his or her neck or back.

The top member of the device is further comprised of at least one fastener such that a cushion may be removably attached to the top member of the device. This creates a soft surface for a user to rest his or her head upon. Both the top member and the cushion are generally u-shaped, with the opening portion of the u-shape facing the user. In this manner, the user may lean into and onto the device comfortably. Different embodiments may feature other types of cushions, such as but not limited to inflatable cushions. The bottom member may also be comprised of an inflatable cushion. A valve is located on the inflatable cushion so that a user can inflate and deflate the cushion as necessary. When the cushion is inflated, a user may utilize the inflatable cushion by resting their hands comfortably upon it. A cover of the cushion may be removably attached to the underside of the device in other embodiments and may also be manufactured with a non-inflatable cushion.

A user may further collapse the device and place it in a carrying bag when the device is not deployed for use. The device folds together where the top member meets the vertical frame member, and the bottom member meets the vertical frame member. A flap is fixed on one side of the carrying bag and may be folded over and removably attached to the case by at least one fastener. A strap is fastened to the carrying bag to allow the user to transport the device.

Accordingly, the portable sleeping device of the present invention is particularly advantageous as it eliminates the pain and discomfort commonly associated with sleeping while traveling by reducing the steepness of the angle that a user has to be in when they lean forward to put his or her head down. Because the device is fitted with a cushion, the device affords the user additional comfort when sleeping while traveling. Moreover, because the device is collapsible, it is easily transportable in a carrying bag. In this manner, the portable sleeping device overcomes the limitations of existing sleeping devices and methods known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
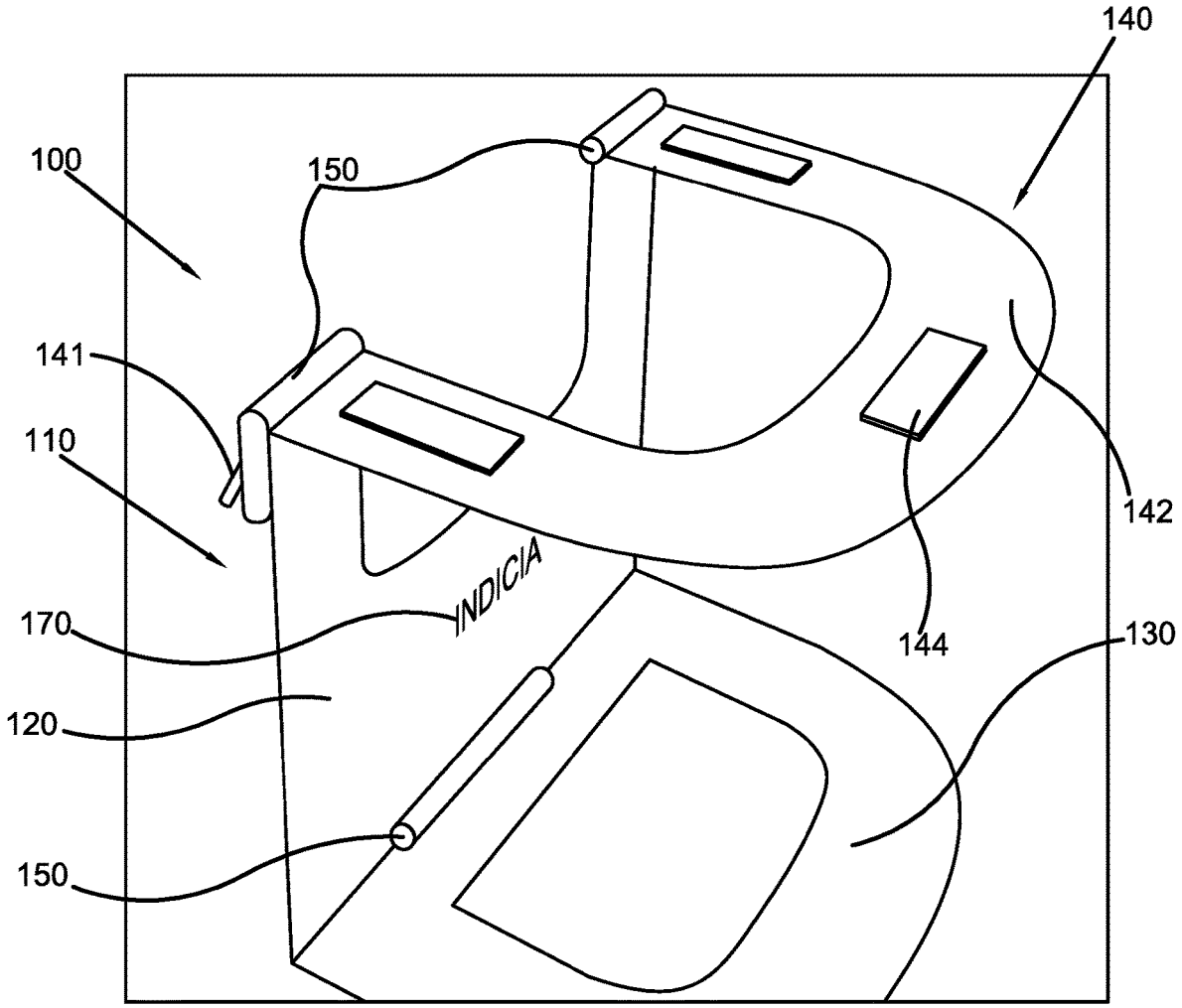
FIG. 1 illustrates a perspective view of one potential embodiment of a portable sleeping device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention, and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a portable sleeping device that reduces the pain and soreness that results from sleeping in cars, planes, trains, etc. Moreover, there exists a long-felt need in the art for a portable sleeping device that is comfortable. There also exists a long-felt need in the art for a portable sleeping device that can be folded down so a user may transport it in a carrying bag.

The present invention, in one exemplary embodiment, is comprised of a portable sleeping device. The device's body is mainly manufactured in three components: a top, a bottom and a vertical frame. The components are preferably fastened together through a series of hinges. The hinges allow the device to be collapsed and folded so a user can transport the device in a carrying case. When deployed, the hinges may be locked. In this manner, the top and bottom members of the body may be secured to the vertical frame at a 90-degree angle. The resulting structure creates a surface that is lifted high enough for a user to rest his or her head on it without straining the neck or back.

The top member of the device is further comprised of at least one fastener such that a cushion may be removably attached to the top member of the device. A cushion may be removably attached to the top segment of the device to create a soft surface for a user to rest his or her head on. The top member of the device and the cushion are generally u-shaped so that the opening portion of the u-shape faces the user. In this manner, the user may lean into and onto the device without being impeded. Other embodiments of the device may feature different types of cushions, such as but not limited to inflatable cushions. The bottom member of the device is preferably fixed with an inflatable cushion that can be inflated through a valve. The user may reach around the vertical frame of the device and rest their hands comfortably on the inflatable cushion. Other embodiments of the device may feature a cushion that can be removably attached to the bottom segment of the device. The device may also be manufactured with non-inflatable cushions similar to the removable cushion attached to the top member.

When the device is not deployed for use, a user may collapse the device and place it in a carrying bag. The device collapses where the top member meets the vertical frame member and where the bottom member meets the vertical frame member. Once placed in the carrying bag, a flap fixed to the carrying bag on one side may be folded over and removably attached to the case by at least one fastener. A strap is fastened to the carrying bag to allow the user to transport the device.

Referring initially to the drawings, FIG. 1 illustrates a perspective view of one potential embodiment of a portable sleeping device 100 of the present invention in accordance with the disclosed architecture. The device 100 is primarily comprised of a body 110 that is further comprised of at least one vertical frame member 120, at least one bottom member 130 with at least one inflatable cushion 132, at least one top member 140, at least one cushion 160, and at least one carrying case 200. The bottom member 130, vertical frame member 120, and top member 140 are preferably manufactured from a rigid and durable plastic such as, but not limited to: acrylic, polycarbonate, polyethylene, thermoplastic, acrylonitrile butadiene styrene, low-density polyethylene, medium density polyethylene, high-density polyethylene, polyethylene terephthalate, polyvinyl chloride, polystyrene, polylactic acid, acetal, nylon, fiberglass, etc. In different embodiments, the bottom member 130, vertical frame member 120 and top member 140 may also be manufactured from any metal known in the art such as, but not limited to, stainless steel or aluminum.

Figure 3:
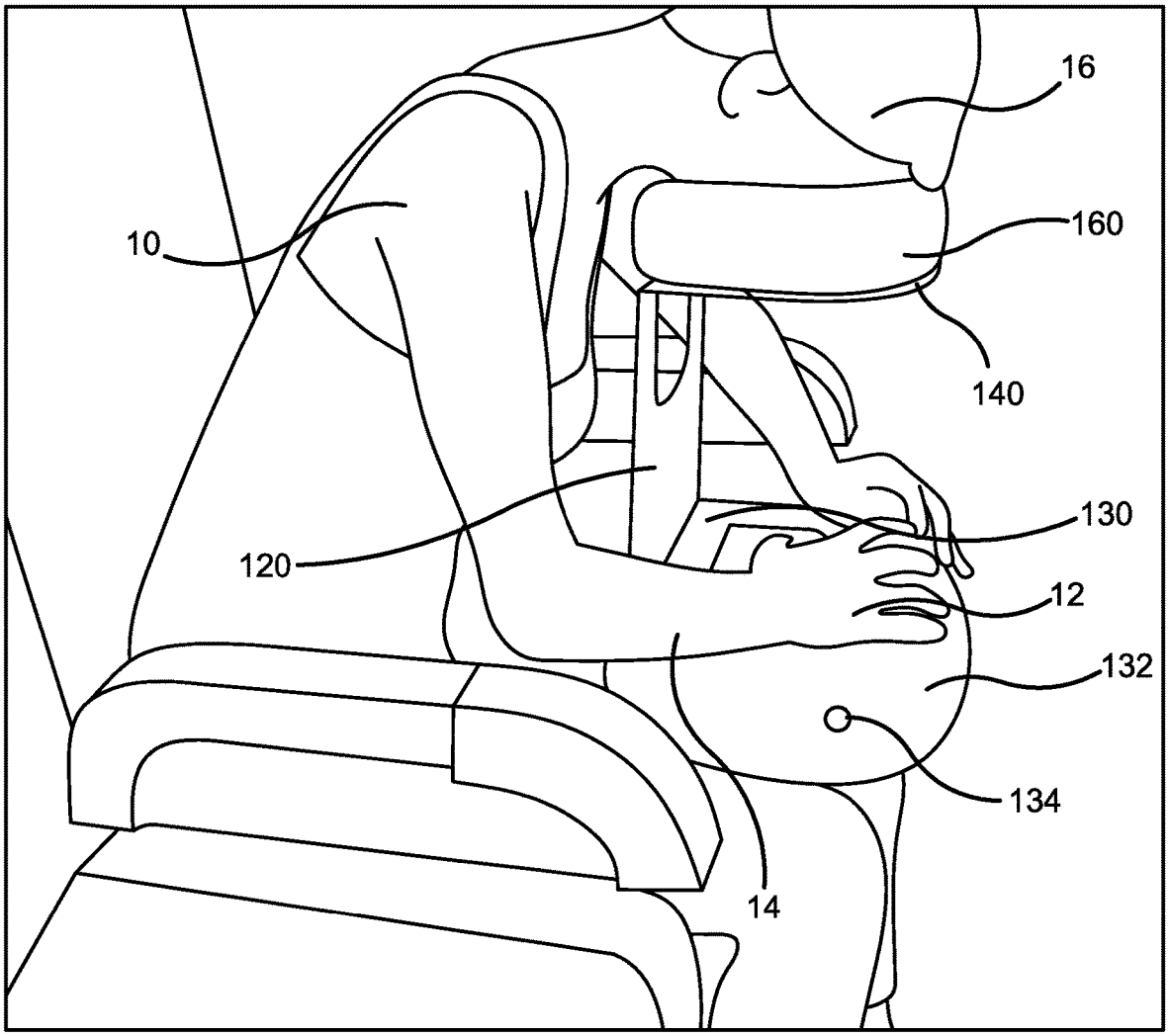
FIG. 3 illustrates a perspective view of one potential embodiment of a portable sleeping device of the present invention while being used by a user in accordance with the disclosed architecture.

The top member 140 is generally u-shaped such that a user's 10 head 16 may lower into the device 100 while being held up and supported by the outer edges of the top member 140. The vertical frame member 120 is also preferably generally u-shaped such that a user's 10 body may lean forward into the device 100 (as seen in FIG. 3). The top surface 142 of the top member 140 is further comprised of at least one fastener 144. In the preferred embodiment, the fastener 144 is a hook and loop fastener, but said fastener 144 may be any other fastener known in the art that allows a removable attachment such as, but not limited to, a magnet, a snap button, zipper, adhesive, etc. In this manner, a user 10 may removably attach a cushion 160 to the top surface 142 of the top member 140 to provide extra comfort when the device 100 is deployed for use. In a differing embodiment, the fastener 144 may receive at least one cover 161. The cover 161 is made from a soft fabric material and has an outer surface with at least one fastener 144 that can be used to attach the cover to the fastener 144 of the top surface 142. The cover 161 can be removably secured around the cushion 160 such that a user can insert their own cushion into the cover 161 and use said cushion with the device 100. The cover 161 is further washable and may have at least one fastener 144 that secures the cover 161 around the cushion 160 once the cushion 160 is inside the cover 161.

The bottom member 130, vertical frame member 120 and top member 140 are further comprised of at least one hinge 150. One hinge 150 may be fastened between the bottom member 130 and the vertical framer member 120. Another hinge 150 may be fastened between the vertical frame member 120 and the top member 140. In this manner, the body 110 of the device 100 may collapse in on itself and fold to compactly fit in a carrying case 200. The hinges 150 may be any hinge 150 known in the art such as, but not limited to, an offset blind hinge, a knuckle hinge, a butt hinge, a rising butt hinge, a gravity pivot hinge, a ball bearing hinge, a barrel hinge, a concealed hinge, a knife hinge, a piano hinge, a strap hinge, a pivot hinge, a gas-piston hinge, an injection molded hinge, a locking hinge, etc. Preferably, the hinge 150 is manufactured with a locking function such that the bottom member 130, vertical frame member 120, and top member 140 may form at least two 90-degree angles while being used. In this manner, the device 100 can withhold the weight of the user 100 while the hinges 150 remain locked in said position. In the preferred embodiment, the hinges 150 are spring-loaded (with a slight amount of give) and can be locked via at least one lever 141 in a position between 45 and 90 degrees relative to the vertical frame member 120. Alternatively, the hinges 150 can move between 180 degrees relative to the vertical frame member 120.

To enhance the appearance of the device 100, the bottom member 130, vertical frame member 120, top member 140 and cushion 160 may be comprised of a plurality of decorative indicia 170 such as but not limited to patterns, logos, emblems, images, symbols, designs, letters, words, characters, animals, advertisements, brands, etc. Different embodiments of the device 100 may also be any color known in the art.

Figure 2:
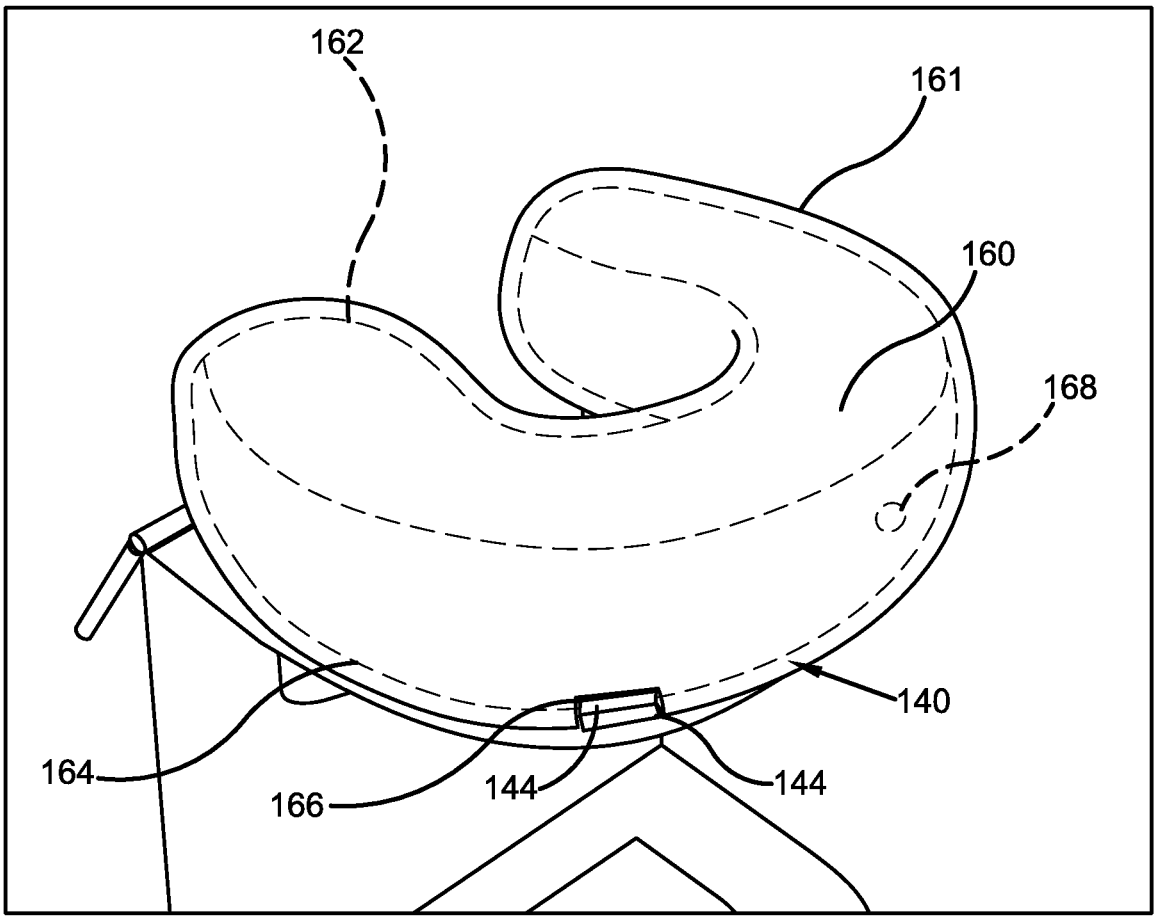
FIG. 2 illustrates a perspective view of one potential embodiment of a portable sleeping device of the present invention in accordance with the disclosed architecture.

FIG. 2 illustrates a perspective view of one potential embodiment of a portable sleeping device 100 of the present invention in accordance with the disclosed architecture. The device 100 is preferably designed to accept a u-shaped cushion 160 such that a user 10 may rest their head comfortably on the device 100. The bottom surface 165 of the cushion 160 may have at least one fastener 166 that removably attaches to at least one fastener 144 located on the top surface 142 of the top member 140. The fastener 166 is preferably of the same (or similar) fastener type as the fastener 144 of the top surface 142, wherein the fastener 166 is compatible with the fastener 144 of the top surface 142. The cushion 160 is further preferably manufactured from any padded material known in the art such as, but not limited to, memory foam, inflatable rubber, plastic, etc. The foam may also be encased in a soft, removable, and washable, fabric cover 161 made from, but not limited to, vinyl, canvas, cashmere, chenille, chiffon, cotton, damask, jersey, lace, linen, wool, modal, polyester, satin, silk, spandex, suede, tweed, twill, velvet, acrylic, modacrylic, nylon, polypropylene, polyurethane, polyvinyl chloride, polyethylene, vinylidene, benzoate, aramid, rayon, acetate, triacetate, etc. In one embodiment, the cushion 160 may further be inflatable, wherein it is inflated by at least one valve 168.

FIG. 3 illustrates a perspective view of one potential embodiment of a portable sleeping device 100 of the present invention while being used by a user 10 in accordance with the disclosed architecture. The vertical frame member 120 is preferably deployed upright with the top member 140 and bottom member 130 each locked between a 45 and a 90-degree angle to the vertical frame member 120 via hinges 150. In this manner, the user 10 may lean forward into and onto the device 100 without the device 100 collapsing. The u-shaped design of the cushion 160 creates an opening 162 so that the face of the user 10 is not obstructed or impeded by the device 100. The cushion 160 supports the user's head 16 through contact with the area around the perimeter of the user's 10 face. Further, the forward position of the user 10 while using the device 100 reduces spinal tension.

The user 10 may also reach his or her arms 14 around the vertical frame member 120 and rest the hands 12 on the bottom member 130 for comfort. The bottom surface 164 of the bottom member 130 preferably has a non-skid material such as but not limited to rubber or neoprene that prevents the bottom surface 164 from sliding on the lap of a user 10 or against the inflatable cushion 132. The bottom surface 164 of the bottom member 130 may be manufactured with at least one fastener 144 known in the art, which allows for attachment of an optional inflatable cushion 132. The inflatable cushion 132 can then be blown up or deflated through a valve 134 located on the surface of the inflatable cushion 132. The inflatable cushion 132 is preferably fixedly attached to the bottom surface of the bottom member 130 to provide height to the device 100 to ensure comfort in various seating arrangements. The cushion 132 may also have the same type of cover 161, as described above, as the cushion 160. In different embodiments, the inflatable cushion 132 may be removably attached from at least one fastener 144 located on the bottom surface 164 of the bottom member 130. Other embodiments of the device 100 may be comprised of a non-inflatable cushion 160 manufactured from any padded material known in the art such as, but not limited to, memory foam.

Figure 4:
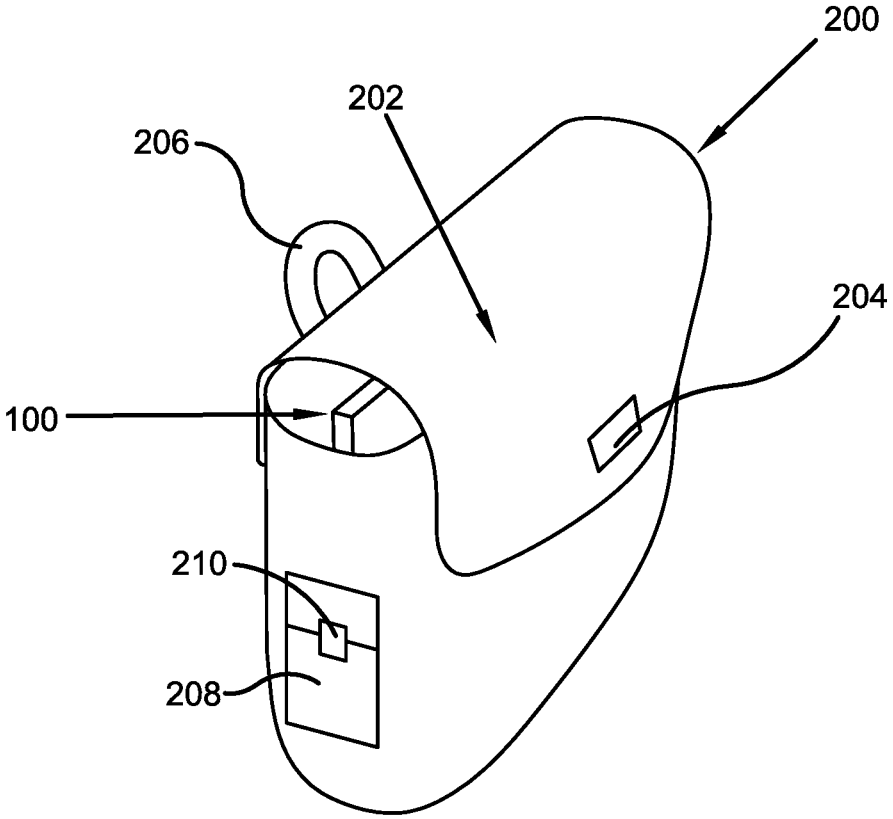
FIG. 4 illustrates a perspective view of one potential embodiment of a portable sleeping device of the present invention while being stored in a carrying case in accordance with the disclosed architecture.

FIG. 4 illustrates a perspective view of one potential embodiment of a portable sleeping device 100 of the present invention while being stored in a carrying case 200 in accordance with the disclosed architecture. The device 100 is further comprised of a carrying case 200 manufactured from durable and lightweight material such as, but not limited to, plastic or fabric. The device 100 may be stowed in a folded position within in the carrying case 200 by collapsing the device 100. Once the device 100 is placed in the opening of the carrying case 200, a flap 202 may be placed over the device 100. The flap 202 may be removably secured by at least one fastener 204 such as, but not limited to, a magnet, snap button, hook and loop, etc. to the carrying case 200. At least one hand and/or shoulder strap 206 may be fixedly or removably attached to the carrying case 200 to provide an easy mechanism for the user 10 to transport the carrying case 200. The case 200 has at least one pocket 208 that is further secured by at least one fastener 210 such as, but not limited to: snap button, zipper, hook and loop, etc.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "portable sleeping device" and "device" are interchangeable and refer to the portable sleeping device 100 of the present invention.

Notwithstanding the forgoing, the portable sleeping device 100 of the present invention and its various components can be of any suitable size and configuration as is known in the art without affecting the overall concept of the invention, provided that they accomplish the above-stated objectives. One of ordinary skill in the art will appreciate that the size, configuration and material of the portable sleeping device 100 as shown in the FIGS. are for illustrative purposes only, and that many other sizes and shapes of the portable sleeping device 100 are well within the scope of the present disclosure. Although the dimensions of the portable sleeping device 100 are important design parameters for user convenience, the portable sleeping device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A portable sleeping device comprising:

a cushion;

a planar single piece vertical frame member said planar single piece vertical plane member having a straight bottom edge with a U-shaped cutout thereabove terminating in two separate top edges;

a planar single piece bottom member having a generally D-shape wherein a straight edge connects with said straight bottom edge of said planar single piece vertical frame member and said planar single piece bottom member also having a curved edge that extends outward from said straight bottom edge of said planar single piece vertical frame member thereby forming an aperture in a center portion of said planar single piece bottom member;

a planar single piece top member being generally U-shaped and having a rounded inner and outer edge thereby creating an open space proximate said rounded inner edge where said planar single top member connects with said U-shaped cutout of said planar single piece vertical member at said two separate top edges thereby creating an open space therebetween;

a locking lever between said planar single piece bottom member and said planar single piece vertical frame member; and a hinge between said planar single piece top member and said planar single piece vertical frame member wherein said planar single piece top member attaches directly to said planar single piece vertical frame member wherein said hinge provides for an angle between said planar single piece top member and said planar single piece vertical frame member that is either 0 degrees or 90 degrees.

2. The portable sleeping device of claim 1, wherein the cushion is generally u-shaped.

3. The portable sleeping device of claim 2, wherein the cushion is further comprised of a cover that attaches to the top member via a fastener.

4. The portable sleeping device of claim 2, wherein the cushion is inflatable and is manufactured from a rubber or plastic material.

5. The portable sleeping device of claim 1, wherein the planar single piece bottom member extends outwardly at a 90-degree angle from the planar single piece vertical frame member.

6. A portable sleeping device comprising:

a planar single piece vertical frame member said planar single piece vertical plane member having a straight bottom edge with a U-shaped cutout thereabove terminating in two separate top edges;

a planar single piece top member being generally U-shaped and having a rounded inner and outer edge thereby creating an open space proximate said rounded inner edge where said planar single top member connects with said U-shaped cutout of said planar single piece vertical member at said two separate top edges thereby creating an open space therebetween, said planar single piece top member being directly hingedly attached to the planar single piece vertical frame member at said two separate top edges and rotatable between a first position at 0 degrees and a second position at 90 degrees via a locking lever;

a first cushion within a cover that is attached to the planar single piece top member;

a planar single piece bottom member having a generally D-shape wherein a straight edge connects with said straight bottom edge of said planar single piece vertical frame member and said planar single piece bottom member also having a curved edge that extends outward from said straight bottom edge of said planar single piece vertical frame member thereby forming an aperture in a center portion of said planar single piece bottom member wherein said planar single piece bottom member is hingedly attached to the planar single piece vertical frame member and rotatable between an open position and a closed position; and a second cushion within a cover that is attached to the bottom member.

7. The portable sleeping device of claim 6, wherein the first cushion is generally u-shaped.

8. The portable sleeping device of claim 7, wherein the cover of the first cushion attaches to the planar single piece top member via a fastener.

9. The portable sleeping device of claim 7, wherein the first cushion and the second cushion are inflatable and are both comprised of a valve.

10. The portable sleeping device of claim 6, wherein the planar single piece bottom member extends outwardly from the planar single piece vertical member at a 90-degree angle when in the open position.

11. A portable sleeping device comprising:

a planar single piece vertical frame member said planar single piece vertical plane member having a straight bottom edge with a U-shaped cutout thereabove terminating in two separate tot) edges;

a planar single piece top member being generally U-shaped and having a rounded inner and outer edge thereby creating an open space proximate said rounded inner edge where said planar single top member connects with said U-shaped cutout of said planar single piece vertical member at said two separate top edges thereby creating an open space therebetween, said planar single piece top member being directly hingedly attached to the planar single vertical frame member at said two separate top edges and rotatable between a first position at 0 degrees and a second position at 90 degrees;

a first cushion within a cover that is attached to the planar single piece top member;

a planar single bottom member having a generally D-shape wherein a straight edge connects with said straight bottom edge of said planar single piece vertical frame member and said planar single piece bottom member also having a curved edge that extends outward from said straight bottom edge of said planar single piece vertical frame member thereby forming an aperture in a center portion of said planar single piece bottom member wherein said planar single piece bottom member is hingedly attached to the planar single piece vertical frame member and rotatable between an open position and a closed position;

a second cushion within a cover that is attached to the bottom member; and a carrying case.

12. The potable sleeping device of claim 11, wherein the first cushion is generally u-shaped.

13. The potable sleeping device of claim 12, wherein the cover of the first cushion attaches to the planar single piece top member via a fastener.

14. The portable sleeping device of claim 12, wherein the first cushion and the second cushion are inflatable and are both comprised of a valve.

15. The portable sleeping device of claim 11, wherein the planar single piece top member extends directly outwardly from the planar single piece vertical member at a 90-degree angle when in the second position.

16. The portable sleeping device of claim 11, wherein the cover of the second cushion removably attaches to a bottom surface of the planar single piece bottom member.

17. The portable sleeping device of claim 11, wherein the carrying case further comprises at least one of a shoulder strap or a hand strap.

* * * * *